US006884142B2

(12) United States Patent
Kang et al.

(10) Patent No.: US 6,884,142 B2
(45) Date of Patent: Apr. 26, 2005

(54) PLASMA DISPLAY PANEL AND METHOD OF MANUFACTURING PARTITIONS THEREOF

(75) Inventors: Tae-kyoung Kang, Cheonan (KR); Ki-jung Kim, Gongju (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/449,029

(22) Filed: Jun. 2, 2003

(65) Prior Publication Data

US 2003/0197469 A1 Oct. 23, 2003

Related U.S. Application Data

(63) Continuation of application No. 09/840,290, filed on Apr. 24, 2001, now Pat. No. 6,828,731.

(30) Foreign Application Priority Data

Apr. 24, 2000 (KR) ..... 10-2000-21645
Oct. 25, 2000 (KR) ..... 10-2000-62873

(51) Int. Cl.[7] ..... H01J 9/00; H01J 17/49; H01J 9/40

(52) U.S. Cl. ..... 445/25; 445/24; 313/586; 313/587

(58) Field of Search ..... 445/24, 25; 313/582; 430/312, 313, 319, 320

(56) References Cited

U.S. PATENT DOCUMENTS 5,754,003 A 5/1998 Murai et al.
5,860,843 A * 1/1999 Kasahara ..... 445/24
5,909,261 A 6/1999 Seki et al.
6,242,859 B1 6/2001 Betsui et al.
6,285,128 B1 9/2001 Amemiya
6,313,579 B1 11/2001 Nakano et al.
6,414,434 B1 * 7/2002 Nakano et al. ..... 313/582

FOREIGN PATENT DOCUMENTS

| | | | |
|---|---|---|---|
| EP | 01303578.7 | 4/2003 | |
| JP | 03037933 | 2/1991 | |
| JP | 05135702 A * | 6/1993 | ..... H01J/17/49 |
| JP | 8-255574 | 10/1996 | |
| JP | 10283936 | 10/1998 | |
| JP | 11-185634 | 7/1999 | |
| JP | 11-296139 | 10/1999 | |
| JP | 2000030618 | 1/2000 | |
| JP | 2000036254 | 2/2000 | |

* cited by examiner

*Primary Examiner*—Mariceli Santiago
(74) *Attorney, Agent, or Firm*—McGuire Woods LLP

(57) ABSTRACT

A plasma display panel includes a front glass substrate and a rear glass substrate coupled to each other by a sealing material coated at edges of the front and rear glass substrates, first and second electrodes disposed perpendicular to each other on opposing inner surfaces of the front and rear glass substrates facing each other, a dielectric layer formed on each of the opposing inner surfaces of the front and rear glass substrates to cover the first and second electrodes, partitions formed on an upper surface of the dielectric layer of the rear glass substrate, red, green and blue fluorescent substances coated between the partitions, and a non-light emitting zone filling portion formed by filling a non-light emitting zone existing between the outermost one of the partitions and the sealing material with a material used for one of the partitions.

11 Claims, 7 Drawing Sheets

PLASMA DISPLAY PANEL AND METHOD OF MANUFACTURING PARTITIONS THEREOF

CROSS-REFERENCE TO RELATED APPLICATIONS

This application is a continuation of U.S. patent application Ser. No. 09/840,290, filed Apr. 24, 2001, now U.S. Pat. No. 6,828,731, which claims the benefit of Korean Application Nos. 00-62873 and 00-21645, filed respectively on Oct. 25, 2000 and Apr. 24, 2000, in the Korean Industrial Property Office, the disclosures of which are incorporated herein by reference.

BACKGROUND OF THE INVENTION

1. Field of the Invention

The present invention relates to a plasma display panel and a method of manufacturing partitions thereof, and more particularly, to a plasma display panel in which neon light emission due to mis-discharge in a non-light emitting zone is fundamentally removed, and to a method of manufacturing partitions thereof.

2. Description of the Related Art

A typical plasma display device for displaying an image by using a gas discharge phenomenon is widely noted for its superior display capabilities (display capacity, brightness, contrast, afterimage, and a viewing angle) so as to replace a CRT. In the plasma display device, discharge is generated between electrodes in a gas by direct current or alternating current applied to the electrodes. Then, a fluorescent substance is excited by an ultraviolet ray radiated as the discharge is generated, and a light is emitted.

FIG. 1 is an exploded perspective view showing a panel of a typical alternating current type plasma display device. Referring to the drawing, a first electrode 13*a*, which is a transparent display electrode, and a second electrode 13*b*, which is an address electrode, are formed between a front glass substrate 11 and a rear glass substrate 12. The first electrode 13*a* includes an X electrode and a Y electrode. A sustaining discharge is generated between a pair of the first electrodes 13*a* during operation of the panel. The first and second electrodes 13*a* and 13*b* are formed in strips, facing to each other, on the inner surfaces of the front glass substrate 11 and the rear glass substrate 12, respectively. When the front and rear glass substrates 11 and 12 are coupled to each other, the first and second electrodes 13*a* and 13*b* cross each other. A dielectric layer 14 and a protective layer 15 are stacked in order on the inner surface of the front glass substrate 11. Partitions 17 are formed on the upper surface of a dielectric layer 14' formed on the rear glass substrate 12. A cell 19 is formed by the partitions 17 and is filled with an inert gas such as neon (Ne) and xenon (Xe). A fluorescent substance 18 is coated on a predetermined portion of the inside of each cell 19. A bus electrode 13*c* is formed on the surface of the first electrode 13*a* to prevent line resistance, which increases as the length of the first electrode 13*a* increases.

In the operation of the plasma display device having the above structure, first, a high voltage (a trigger voltage) is applied to generate a discharge between the X electrode of the first electrode 13*a* and the second electrode 13*b*. When anions are accumulated in the dielectric layer 14 by the trigger voltage, the discharge is generated. When the trigger voltage exceeds a threshold voltage, the discharge gas in the cell 19 becomes a plasma state by the discharge. Thus, a stable discharge state can be maintained between pairs of the first electrodes 13*a* (see FIG. 2). In this sustaining discharge state, of the discharge lights generated, light in a range of an ultraviolet area collides with the fluorescent substance 18 and emits another light. Accordingly, each pixel formed by a unit of the cell 19 can display an image.

FIG. 2 is a sectional view showing the assembled plasma display panel of FIG. 1 by cutting the partitions in a widthwise direction. The same reference numerals are used for the same elements shown in FIGS. 1 and 2.

Referring to the drawing, the front glass substrate 11 and the rear glass substrate 12 are coupled to each other with the partitions 17 interposed therebetween. Such coupling is made by a sealing material having similar properties to those of a substrate material such as a frit glass 22 coated between the front and rear glass substrates 11 and 12. The frit glass 22 is coated on the inner surfaces of the front and rear substrates 11 and 12 along the edge thereof. The frit glass 22 is heated and melted in a state in which the front and rear substrates 11 and 12 are pressed against each other, and then is solidified so that the substrates 11 and 12 can be combined by being attached to each other.

An outermost partition 23 is positioned at the edge of the substrates 11 and 12 and defines a non-light emitting zone 21 with the frit glass 22. That is, the non-light emitting zone 21 is defined between the outermost partition 23 and the frit glass 22. Since the second electrode 13*b* is not formed in the non-light emitting zone 21, and since the fluorescent substance 18 is not coated thereon, theoretically, no discharge is generated. The non-light emitting zone 21 is also called a dummy and margin zone, and is formed at the outskirts of a display where an image is displayed. Within the dummy and margin zone 21, the dummy zone prevents an edge effect that may occur in discharge cells 19 at the outermost area of the display, and the margin zone compensates for a limit in accuracy of the manufacturing processes. The dummy and margin zone 21 is designed considering a property of each of the layers of a plasma display panel. However, since the non-light emission zone 21 is actually filled with the discharge gas filled in the discharge cell 19, when the sustaining discharge is generated between a pair of first electrodes 13*a*, discharge is generated in the non-light emitting zone 21. Such a mis-discharge phenomenon causes light emission by the discharge gas itself. In particular, a light emission phenomenon of an orange color occurs. Thus, the overall color purity of a display is lowered due to the presence of the non-light emitting zone 21.

To prevent such a phenomenon, a dummy electrode is used in the conventional technology. For example, a plurality of dummy electrodes is formed parallel to an address electrode at a portion corresponding to the outermost portion of a display area. The dummy electrodes are electrically connected to one another to be connected in common with an external connection terminal. Also, a dummy electrode is formed parallel to an address electrode at a portion corresponding to the outermost portion of a display area. The outermost address electrode and the dummy electrode are electrically connected to each other. Further, a plurality of dummy electrodes is formed parallel to an address electrode at a portion corresponding to the outermost portion of a display area. The outermost address electrode and the dummy electrode are electrically connected to each other. A predetermined voltage is applied to the outermost address electrode during a priming discharge period, an address discharge period, and a sustain discharge period. However, since the above conventional technologies require an additional dummy electrode, the structures thereof become complicated.

SUMMARY OF THE INVENTION

To solve the above problem, it is an object of the present invention to provide a plasma display panel which can prevent a mis-discharge phenomenon in a non-light emitting zone.

It is another object of the present invention to provide a method of manufacturing partitions of the plasma display panel to prevent a mis-discharge phenomenon in the non-light emitting zone.

Additional objects and advantages of the invention will be set forth in part in the description which follows and, in part, will be obvious from the description, or may be learned by practice of the invention.

Accordingly, to achieve the above and other objects, there is provided a plasma display panel according to an embodiment of the present invention comprising a front glass substrate and a rear glass substrate coupled to each other by a sealing material coated at edges of the front and rear glass substrates, first and second electrodes respectively formed to cross each other on opposing inner surfaces of the front and rear glass substrates, a dielectric layer formed on each of the opposing inner surfaces of the front and rear glass substrates to cover the first and second electrodes, respective partitions formed on an upper surface of the dielectric layer of the rear glass substrate; red, green and blue fluorescent substances coated between the partitions, and a non-light emitting zone filling portion formed by filling a non-light emitting zone between an outermost partition among the partitions and the sealing material with a material for the partition.

According to an aspect of the present invention, the outermost partition and the non-light emitting zone filling portion are substantially formed integrally.

According to still another aspect of the present invention, the non-light emitting zone filling portion completely fills a space between the sealing material and the outermost partition.

According to yet another aspect of the present invention, the non-light emitting zone filling portion covers end portions of the first electrodes formed on the front glass substrate.

According to a further aspect of the present invention, a gas exhaust hole is formed at an upper surface of the non-light emitting zone filling portion parallel to a lengthwise direction of the partition.

According to a yet further aspect of the present invention, a depth of the gas exhaust hole is within a range of 10 $\mu$m through 160 $\mu$m.

According to another embodiment of the present invention, there is provided a plasma display panel comprising a front glass substrate and a rear glass substrate coupled to each other by a sealing material coated at the edges of both substrates, first and second electrodes respectively formed to cross each other on opposing inner surfaces of the front and rear glass substrates, a dielectric layer formed on each of the opposing inner surfaces of the front and rear glass substrates to cover the first and second electrodes, partitions formed on an upper surface of the dielectric layer of the rear glass substrate, red, green and blue fluorescent substances coated between the respective partitions, and a non-light emitting zone filling portion formed by filling a non-light emitting zone between an outermost partition among the partitions and the sealing material to be close to the outermost partition using the material for the partition, thereby forming an empty space between the sealing material and the non-light emitting zone filling portion and covering end portions of the electrodes formed on the front glass substrate.

According to still another aspect of the present invention, a width of the non-light emitting zone filling portion is equal to a length of end portions of the first electrodes on the front glass substrate which extend past the outermost partition.

According to a yet another aspect of the present invention, the width of the non-light emitting zone filling portion is greater than a length of end portions of the first electrodes on the front glass substrate which extend past the outermost partition.

According to a further aspect of the present invention, the sum (W3) of a width of the non-light emitting zone filling portion and a width of the outermost partition is 1.0 mm, and a length of the end portion of each of the first electrodes on the front glass substrate covered by the non-light emitting zone filling portion and the outermost partition is 0.3 mm.

According to a yet further aspect of the present invention, the first electrodes on the front glass substrate extend past the non-light emitting zone filling portion under the condition that the width of the empty space is less than 50 $\mu$m.

According to a still further embodiment of the present invention, there is provided a method of manufacturing partitions of a plasma display panel comprising coating a material for partitions on the upper surface of a dielectric layer on a glass substrate also having electrodes in a predetermined pattern so as to form a cured pattern of dry film resist to shield the partitions and portions corresponding to a non-light emitting zone between an outermost partition and a sealing material by coating a dry film resist on the upper surface of the coated partition material, exposing the dry film resist, and developing the exposed dry film resist, and partially removing the partition material by ejecting abrasion particles at a high speed using the cured pattern as a mask.

BRIEF DESCRIPTION OF THE DRAWINGS

The above and other objects and advantages of the present invention will become more apparent and more readily appreciated from the following description of the preferred embodiments thereof with reference to the attached drawings in which.

DETAILED DESCRIPTION OF THE PREFERRED EMBODIMENTS

Figure 1:
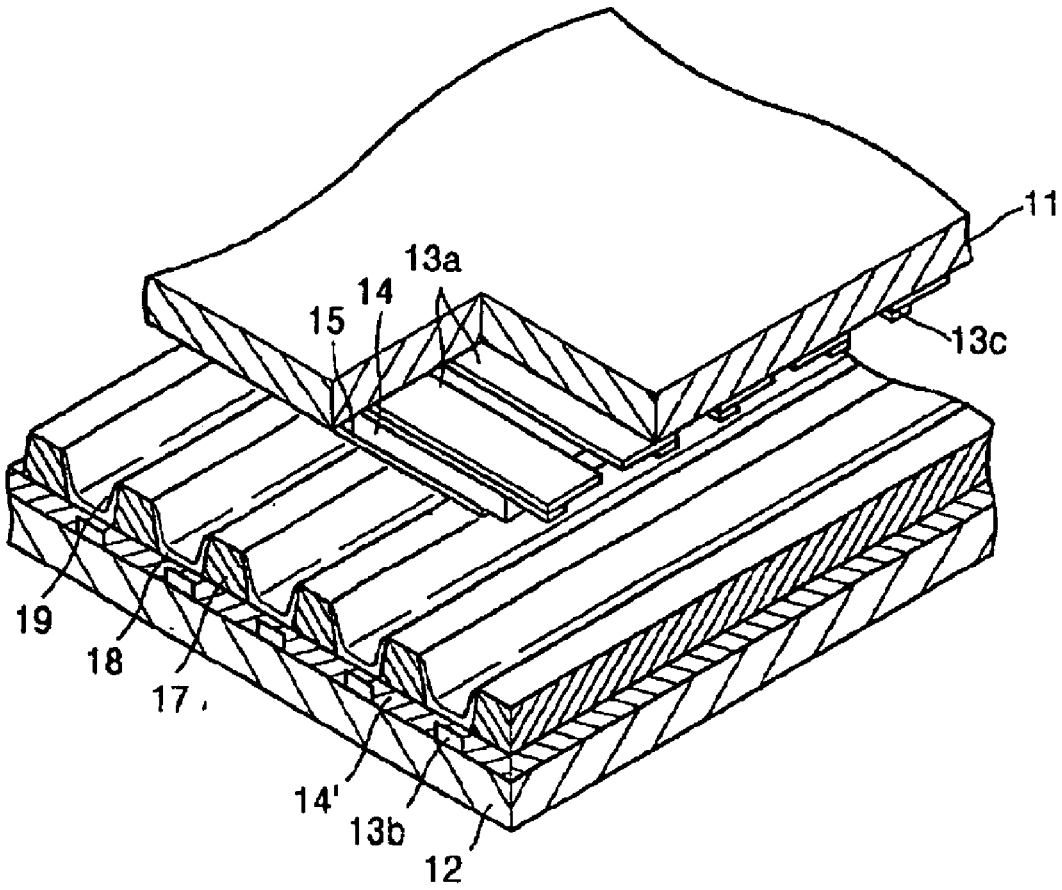
FIG. 1 (PRIOR ART)
FIG. 1 is an exploded perspective view of a conventional plasma display panel.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
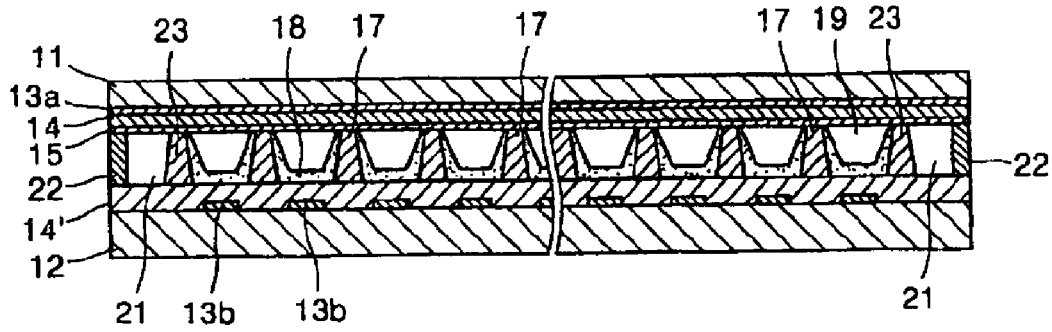
FIG. 2 (PRIOR ART)
FIG. 2 is a sectional view of the conventional plasma display panel of FIG. 1.
Figure 3:
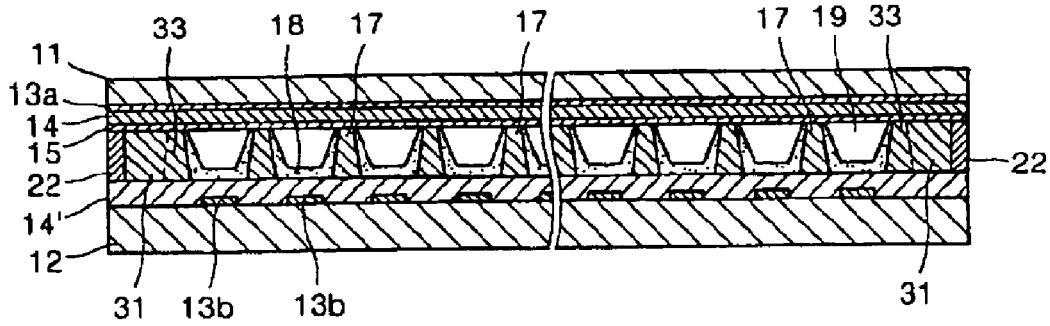
FIG. 3 is a sectional view showing a plasma display panel according to an embodiment of the present invention.

FIG. 3 shows a cross section in a widthwise direction across partitions 17 of a plasma display panel according to an embodiment of the present invention. The same elements as the plasma display panel of FIG. 2 are indicated by the same reference numerals. Referring to FIG. 3, the first electrode 13*a*, a third electrode (not shown), the dielectric layer 14, and the protective layer 15 are formed in order on the front glass substrate 11. The second electrode 13*b*, the dielectric layer 14', and the partitions 17 are formed in order on the rear glass substrate 12. The front and rear glass substrates 11 and 12 are combined with each other by a sealing material such as the frit glass 22. The frit glass 22 is coated on the inner surfaces of the front and rear glass substrates 11 and 12 along the edge thereof, as described above. The frit glass 22 is heated to a melting point and solidified so that the substrates 11 and 12 can be combined by being attached to each other.

A non-light emitting zone filling portion 31 is formed integrally with the outermost partitions 33 in the non-light emitting zone (shown as element 21 in FIG. 2) formed between the outermost partition and the frit glass 22. The non-light emitting zone filling portion 31 completely fills the space in the non-light emitting zone 21 to prevent the non-light emitting zone 21 from being filled with a discharge gas. That is, as can be seen from FIG. 3, the non-light emitting zone filling portion 31 is formed by filling the non-light emitting zone 21 defined between the outermost partition 33 and the frit glass 22 (as indicated by a dotted line) with the same material as used for the partitions 33, where the non-light emitting zone filling portion 31 having the same height as the partitions 33.

The non-light emitting zone filling portion 31 can be understood as one being formed by extending the outermost partition 33 to the inner surface of the frit glass 22. However, it is understood that the non-light emitting zone filling portion 31 could also be separately manufactured and inserted into the non-light emitting zone 21.

In the structure of the plasma display panel of FIG. 3, since the space between the outermost partition 33 and the frit glass 22, which is otherwise filled with a discharge gas, is completely removed. Thus, there is no possibility of a generation of a mis-discharge, and the color purity of the plasma display panel is improved.

The mis-discharge is not generated in the non-light emitting zone 21 in the panel having the structure shown in FIG. 3 both because there is no space to be filled with the discharge gas, and because the end portions of the electrodes 13*a* formed on the front glass substrate 11 are covered by the non-light emitting zone filling portion 31. That is, the end portions of the X electrode or the Y electrode of the electrodes 13*a* formed on the front glass substrate 11 are typically extended lengthwise to end between the frit glass 22 and the outermost partition 33. Since the non-light emission zone filling portion 31 covers the end portions of the first electrodes 13*a*, mis-discharge is not generated. This mechanism will be later described in detail with reference to FIG. 7.

Figure 4A:
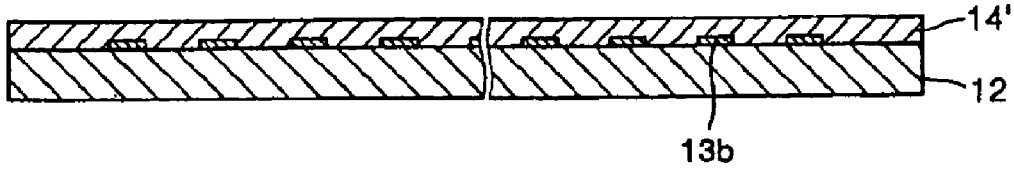
FIGS. 4A through 4E are sectional views showing a method of manufacturing partitions of the plasma display panel of FIG. 3 according to an embodiment of the present invention.
Figure 4B:
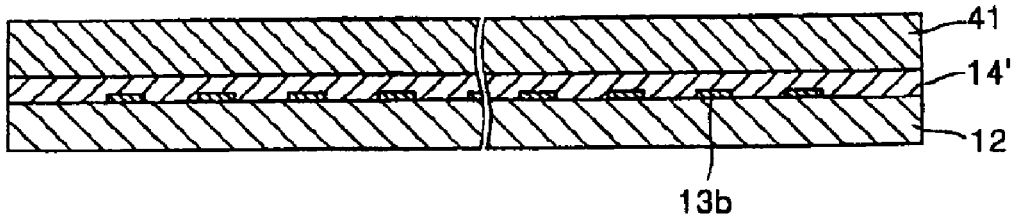
Figure 4C:
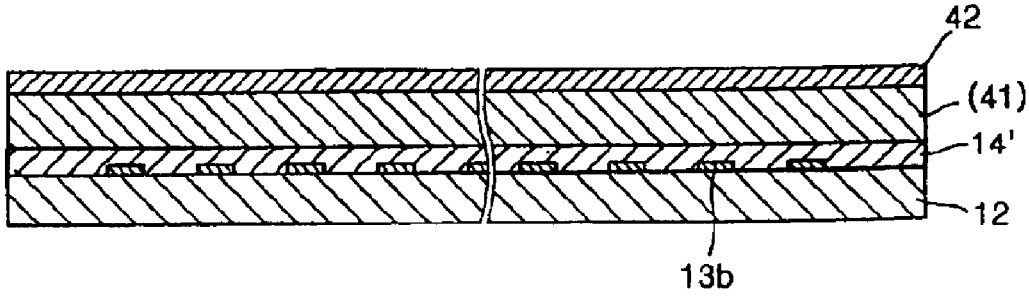

FIGS. 4A through 4E shows a method of manufacturing partitions of the plasma display panel described above according to an embodiment of the present invention. Referring to FIG. 4A, the rear glass substrate 12 is provided. The rear glass substrate has the second electrode 13*b* (an address electrode) and the dielectric layer 14' are formed on the rear glass substrate 12 using a conventional method. Next, as shown in FIG. 4B, a partition material 41 is coated on the entire upper surface of the dielectric layer 14'. FIG. 4C shows that a dry film resist (DFR) is coated on the surface of the partition material 41 to form a DFR layer 42. The DFR layer 42 is formed on the entire surface of the partition material 41.

Figure 4D:
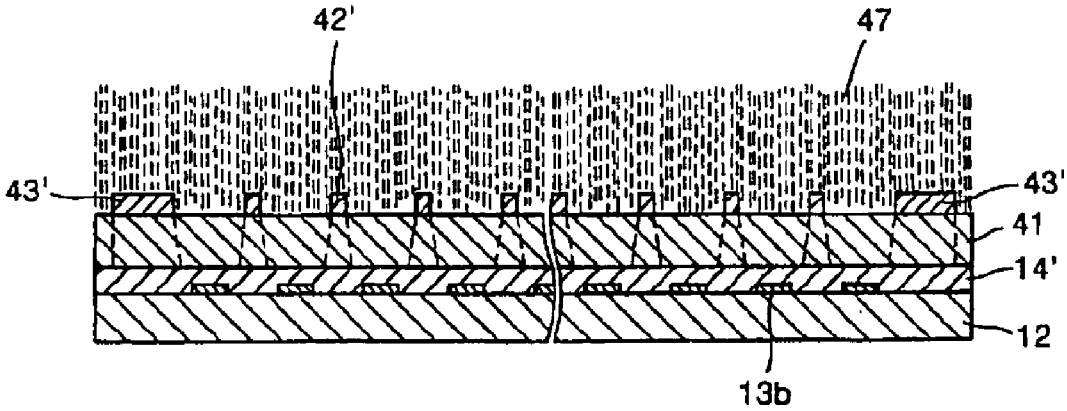

Referring to FIG. 4D, the DFR layer 42 is formed to have a predetermined pattern 42', and the partition material 41 is removed by a sand blasting method to have a predetermined pattern. The DFR layer 42 is formed to have a predetermined cured pattern 42' as shown in FIG. 4D using an exposure and developing processes. That is, the DFR layer 42 is partially cured by the exposure process, and developed so that the cured pattern 42' remains. As shown, in a portion corresponding to the upper portion of the non-light emitting zone 21 shown in FIG. 2, the DFR layer 42 remains in a pattern 43'.

The cured patterns 42' and 43' of the DFR layer 42 serve as masks with respect to abrasion particles 47 ejected at a high speed. Thus, a portion of the partition material 41 not shielded by the cured patterns 42' and 43' is removed by the abrasion particles 47 using sand blasting.

Figure 4E:
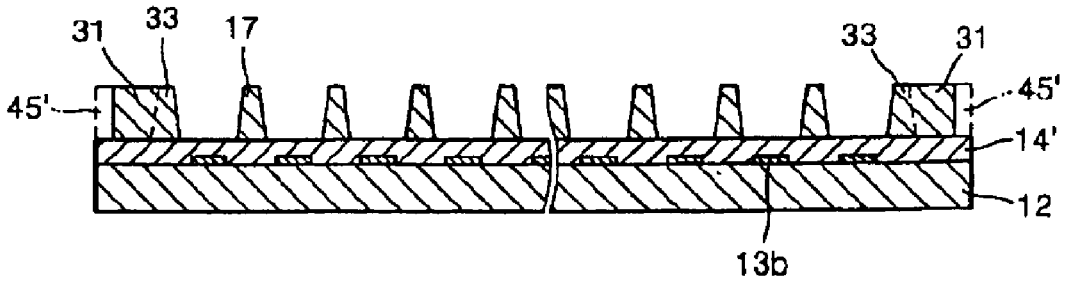

FIG. 4E shows the completed partitions 17 and 33. The cured patterns 42' and 43' are removed after the partitions 17 and 33 are completely formed by the sand blasting method. The outermost partition 33 is located at the outermost position. As shown, substantially, the outermost partition 33 and the non-light emitting zone filling portion 31 are integrally formed. Reference numeral 45' denotes a space where the frit glass 22 shown in FIG. 3 is coated.

Although the method of manufacturing partitions of a plasma display panel using a sand blasting method is shown in FIGS. 4A through 4E, it is obvious that other methods can be adopted to form the non-light emitting zone filling portion 31 using the partition material 41 in the non-light emitting zone 21 shown in FIG. 2. For example, when the partitions 17 and 33 are formed by a printing method, the partition material 41 is printed onto the non-light emitting zone 21 of FIG. 2 so that a plasma display panel of the present invention can be manufactured. In the printing method, the partition material 41 can be printed onto the non-light emitting zone 21 of FIG. 2 by appropriately changing a screen used in the method.

Figure 5:
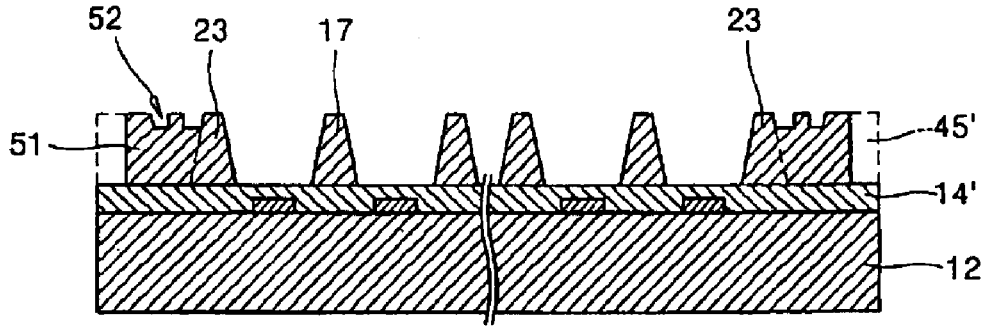
FIG. 5 is a sectional view showing the structure of a rear glass substrate of a plasma display panel according to another embodiment of the present invention.

FIG. 5 shows the structure of a rear glass substrate of a plasma display panel according to another embodiment of the present invention. Referring to FIG. 5, the basic structure is similar to the structure described above and the same elements are indicated by the same reference numerals. As shown in FIG. 5, a non-light emitting zone filling portion 51 is formed between the outermost partition 23 and the frit glass space 45', and a gas exhaust hole 52 is formed at an upper surface of the non-light emitting zone filling portion 51. Thus, end portions of the X electrode and the Y electrode of the electrode 13*a* formed on the front glass substrate (not shown) are partially covered by the non-light emitting zone filling portion 51 having the gas exhaust hole 52.

The gas exhaust hole 52 facilitates the exhaustion of gas from inside the panel. The gas exhaust hole 52 extends in a lengthwise direction parallel to the partitions 17. The depth and width of the gas exhaust hole 52 may be variously formed so that mis-discharge is not generated. When the gas exhaust hole 52 is formed too deep, the amount of a discharge gas filled therein is large. When the width of the gas exhaust hole 52 is formed too wide, the length of an end portion of an electrode exposed in the gas exhaust hole 52 is extended. Typically, when the height of the partition 17 is 160 μm high, the depth of the gas exhaust hole 52 is preferably within a range of 10 μm through 160 μm. Also, the width of one gas exhaust hole 52 is preferably less than 300 μm.

Figure 6A:
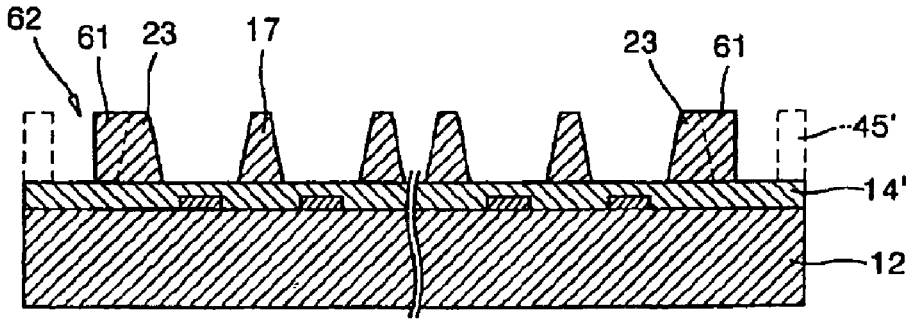
FIG. 6A and FIG. 7 are a sectional view of the rear glass substrate and a bottom view of a front glass substrate of the plasma display panel according to another embodiment of the present invention.
Figure 7:
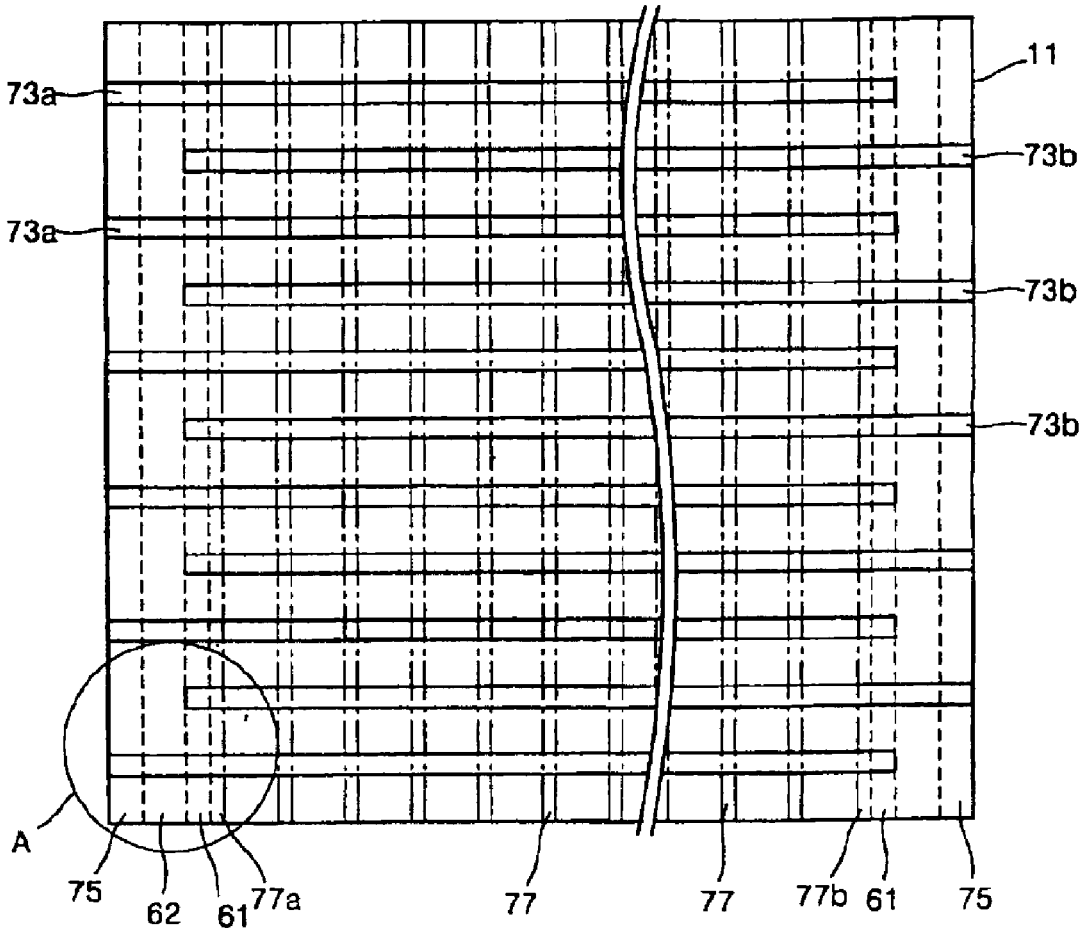

FIGS. 6A and 7 are sectional views of a rear glass substrate and a bottom surface of a front glass substrate of a plasma display panel according to yet another embodiment of the present invention. The structure shown in FIG. 6A is similar to the structure of the plasma display panel described above. The same elements are indicated by the same reference numerals. As shown in FIG. 6A, a non-light emitting zone filling portion 61 is formed in a non-light emitting zone 21 shown in FIG. 2 formed between the outermost partition 23 and the frit glass space 45'. The non-light emitting zone filling portion 61 does not fill the entire space of the non-light emitting zone 21, but partially fills only a portion closest to the outermost partition 23. An empty space 62 is formed between the non-light emitting zone filling portion 61 and the frit glass space 45'. The empty space 62 facilitates the exhaustion and injection of gas. Preferably, the interval between the outermost partition 23 and the frit glass space 45' is 20 mm, and the width of the non-light emitting zone filling portion 61 is less than 10 mm. That is, about half the non-light emitting zone 21 of FIG. 2 between the outermost partition 23 and the frit glass space 45' is filled with the non-light emitting zone filling portion 61, and the remaining empty space 62 is used for exhaustion of gas.

The non-light emitting zone filling portion 61 should be formed such that it can cover each of the end portions of the X electrode 73*a* and the Y electrode 73*b* to be formed on the front glass substrate. That is, as shown in FIG. 7, the X electrode 73*a* and Y electrode 73*b* are formed in pairs parallel to each other on the front glass substrate 11. One end portion of each of the electrodes 73*a*, 73*b* is a terminal connected to an external circuit that starts at the edge of the front glass substrate 11. The other end portion ends at a position corresponding to the space between the outermost partition 23 and the frit glass space 45'. For example, terminals of X electrodes 73*a* are formed at the left edge of the front glass substrate 11 while terminals of Y electrodes 73*b* are formed at the right edge of the front glass substrate 11. Also, the other end portion of the X electrode 73*a*,which is not a terminal, ends at a position corresponding to the space between the outermost partition 23 and the frit glass space 45' at the right side of the substrate, while the other end portion of the Y electrode 73*b*, which is not a terminal, ends at a position corresponding to the space between the outermost partition 23 and the frit glass space 45' at the left side of the substrate. Thus, even when the non-light emitting zone filling portion 61 is formed close to positions 77*a* and 77*b* corresponding to the outermost partitions 23, and the empty space 62 is left between the non-light emitting zone filling portion 61 and the frit glass space 45', the non-light emitting zone filling portion 61 consequently covers all the end portions of the electrodes 73*a* and 77*b* disposed between a portion 75 where frit glass (not shown) is coated and the positions 77*a* and 77*b* corresponding to the outermost partitions 23. The above structure can prevent mis-discharge between the electrodes located between the frit glass coating position 75 and a position 77 where the partitions are formed.

While not shown, it is understood that mis-discharge can also be prevented without having the outermost partition 23 and the non-light emitting zone filling portion 61 be of the same height. For instance, if the height difference is less than 20 μm, mis-discharge is prevented where the width of the empty space 62 is less than 50 μm. Even if the width of the empty space 62 is not less than 50 μm, the probability of mis-discharge is low.

However, when the non-light emitting zone filling portion 61 does not cover all end portions of the electrodes 73*a* and 73*b*, mis-discharge between the electrodes 73*a* and 73*b* can be prevented under a predetermined condition. That is, when the end portions, which are not the terminals for external connection of the X or Y electrodes 73*a* and 73*b*, are not completely covered by the non-light emitting zone filling portion 61, and are extended above the empty space 62 past the non-light emitting zone filling portion 61, mis-discharge is not generated if the width of the empty space 62 is less than 50 μm.

Figure 6B:
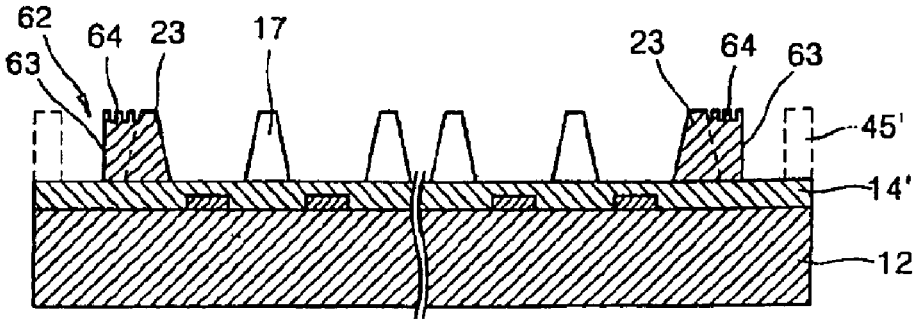
FIG. 6B is a sectional view of a rear glass substrate of a plasma display panel according to yet another embodiment of the present invention.

FIG. 6B shows a plasma display panel according to still yet another embodiment of the present invention. This embodiment may be understood as one combining the embodiments shown in FIGS. 5 and 6A. Referring to FIG. 6B, in a non-light emitting zone 21 of FIG. 2 formed between the outermost partition 23 and the frit glass space 45', a non-light emitting zone filling portion 63 is formed closer to the outermost partition 23, so that an empty space 62 is formed between the non-light emitting zone filling portion 63 and the frit glass space 45'. A gas exhaust hole 64 is formed at an upper surface of the non-light emitting zone filling portion 63. The gas exhaust hole 64 extends in a lengthwise direction of the partition, and may be formed in multiple numbers and parallel to one another. The non-light emitting zone filling portion 63 where the gas exhaust hole 64 is formed covers the end portion of the electrode 13*a* (not shown).

Figure 8:
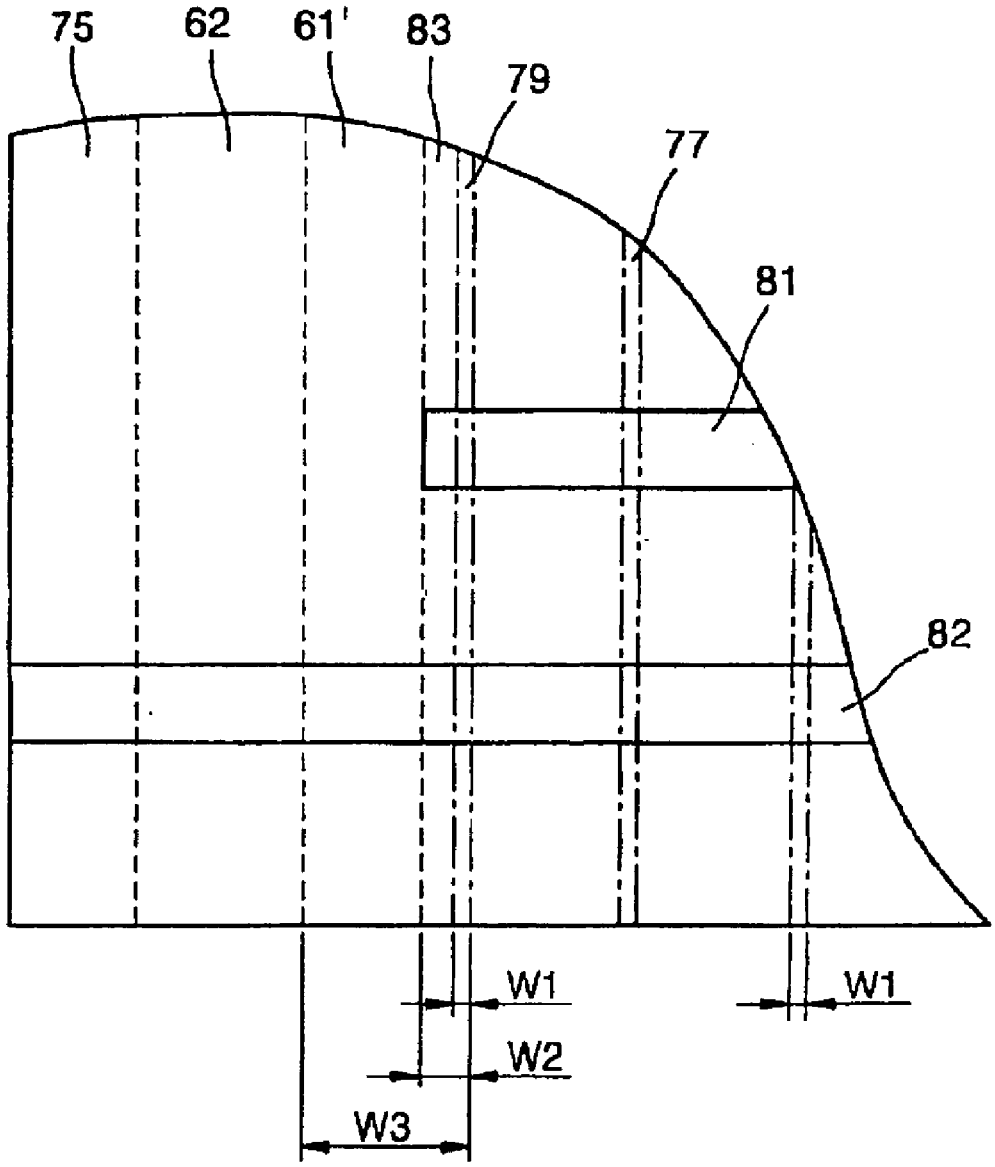
FIG. 8 is a view showing a plasma display panel according to still yet another embodiment of the present invention corresponding to a circled portion of FIG. 7 indicated by reference character A.

FIG. 8 is a view showing a plasma display panel according to still yet another embodiment of the present invention, corresponding to a circled portion of FIG. 7 indicated by reference letter A. The overall structure of the plasma display panel shown in FIG. 8 is similar to that of the plasma display panel shown in FIG. 7, and the same elements are indicated by the same reference numerals. End portions of the X and Y electrodes 81 and 82 formed on the front glass substrate 11 are extended to cross a part of the width of a non-light emitting zone filling portion 61'. The non-light emitting zone filling portion 61 of FIG. 6A formed at each of the left and right sides of the front glass substrate 11 is indicated by reference numeral 61' in FIG. 8, and the outer most partition 23 of FIG. 6A is indicated by reference numeral 79.

An area 83 corresponds to a length of an extended end portion of the electrode 81 from the outermost partition 79 into the non-light emitting zone filling portion 61'. W1 denotes a width of the outermost partition 79, W2 denotes a length of the electrode 81 extending above the upper surface of the outermost partition 79, and W3 denotes the sum of the width W1 and a width of the non-light emitting zone filling portion 61'. Here, the non-light emitting zone filling portion 61' is an area corresponding to the width of W3 excluding W1. Typically, W1 is about 0.1 mm and W3 is about 1.0 mm. The area 83 is about 0.2 mm. Thus, W2, which is the length of an end portion of the electrode 81 covered by the outermost partition 79 and the non-light emitting zone filling portion 61' corresponds to about 0.3 mm. That is, in the embodiment shown in FIG. 7, the end portions of the electrodes 73*a* and 73*b* extend throughout the entire width of the non-light emitting zone filling portion 61' while, in the embodiment shown in FIG. 8, the end portion of the electrode 81 extends over a part of the width of the non-light emitting zone filling portion 61'. The length of the extended end portion of the electrodes covered by the non-light emitting zone filling portion 61' and the outermost partition 79 is about 0.3 mm as described above. In the embodiment shown in FIG. 8, even when the end portions of the electrodes 81 and 82 are extended as the substrate is contracted or expanded, they do not protrude from the non-light emitting zone filling portion 61' into the empty space 62.

As described above, in the plasma display panel according to the present invention, since the end portions of the electrodes are covered by the non-light emitting zone filling portion, mis-discharge caused by mis-alignment of the substrates and an undesired positioning of an end portion of the electrode in a discharge cell as the substrate contracts or expands due to thermal deformation can be prevented. That is, by completely covering the end portion of the electrode with the non-light emitting zone filling portion, if dispersion of process occurs, mis-discharge is prevented since no discharge space is present.

In addition, since the non-light emitting zone is filled with a material used for the partition, intrusion of a discharge gas thereto is fundamentally prevented. Thus, lowering of color purity due to mis-discharge can be prevented.

It is noted that the present invention is not limited to the preferred embodiment described above, and it is apparent that variations and modifications by those skilled in the art can be effected within the spirit and scope of the present invention defined in the appended claims.

What is claimed is:

1. A method of manufacturing a plasma display panel, comprising:

providing a front glass substrate having first electrodes over which a first dielectric layer is formed;

providing a rear glass substrate disposed opposite said front glass substrate, said rear glass substrate having second electrodes over which a second dielectric layer is formed, the second electrodes not being parallel with the first electrodes;

forming partitions and a non-light emitting zone filling portion, the partitions and non-light emitting zone filling portions being formed on the second dielectric layer;

coating a fluorescent substance between the formed partitions;

forming a seal connecting corresponding edges of the front and rear glass substrates, where the non-light emitting zone filling portion is disposed between at least one of an outermost partition and the seal; and forming a gas removal channel adjacent to the non-light emitting zone filling portion and between the outermost partition and the seal, wherein forming the gas removal channel comprises forming the gas removal channel between the non-light emitting zone filling portion and the first dielectric layer.

2. The method of claim 1, wherein said forming the partitions and the non-light emitting zone filling portion comprises:

coating a partition material on the second dielectric layer;

coating a dry film resist on an upper surface of the coated partition material so as to form a mask over the portions of the partition material corresponding to the partitions and the non-light emitting zone filling portion;

removing the partition material not covered by the mask by ejecting abrasion particles.

3. The method of claim 1, wherein said forming the partitions and the non-light emitting zone filling portion comprises:

printing the partitions using a partition material on the second dielectric layer; and printing the non-light emitting zone filling portion using the partition material on the second dielectric layer.

4. The method of claim 3, wherein:

the printing the partitions comprises printing the partitions using a first screen, and the printing the non-light emitting zone filling portion comprises printing the non-light emitting zone filling portion using a second screen.

5. The method of claim 1, further comprising injecting an inert gas into the plasma display panel, wherein the inert gas is not in the space between the outermost partition and the seal.

6. The method of claim 1, further comprising:

exhausting a gas from the plasma display panel through the gas removal channel.

7. The method of claim 1, wherein said forming the gas removal channel comprises forming the gas removal channel between the non-light emitting zone filling portion and the seal.

8. A method of manufacturing a plasma display panel comprising:

providing a front glass substrate having first electrodes over which a first dielectric layer is formed;

providing a rear glass substrate disposed opposite said front glass substrate, said rear glass substrate having second electrodes over which a second dielectric layer is formed, the second electrodes not being parallel with the first electrodes;

forming partitions and a non-light emitting zone filling portion, the partitions and non-light emitting zone filling portions being formed on the second dielectric layer;

coating a fluorescent substance between the formed partitions; and forming a seal connecting corresponding edges of the front and rear glass substrates, where the non-light emitting zone filling portion is disposed between at least one of an outermost partition and the seal and wherein the non-light emitting zone filling portion prevents a discharge of the first electrodes in a space between the outermost partition and the seal.

9. The method of claim 8, wherein the non-light emitting zone filing portion covers at least one of an end portion of the first electrodes formed on the front glass substrate.

10. The method of claim 8, wherein a width of the non-light emitting zone filling portion is equal to a length of the end portion of the first electrodes which extend past the outermost partition.

11. The method of claim 8, wherein a width of the non-light emitting zone filing portion is greater than a length of the end portions of the first electrodes which extend past the outermost partition.

* * * * *